US010138664B2

(12) United States Patent
Bender

(10) Patent No.: US 10,138,664 B2
(45) Date of Patent: Nov. 27, 2018

(54) HINGE WITH ADJUSTABLE AXIS LOCATION AND LOCKING MECHANISM

(71) Applicant: Taylor Made Group, LLC, Gloversville, NY (US)

(72) Inventor: Thomas J. Bender, Fort Wayne, IN (US)

(73) Assignee: TAYLOR MADE GROUP, LLC, Gloversville, NY (US)

( * ) Notice: Subject to any disclaimer, the term of this patent is extended or adjusted under 35 U.S.C. 154(b) by 0 days.

(21) Appl. No.: 15/464,561

(22) Filed: Mar. 21, 2017

(65) Prior Publication Data

US 2017/0268267 A1 Sep. 21, 2017

Related U.S. Application Data

(60) Provisional application No. 62/311,073, filed on Mar. 21, 2016.

(51) Int. Cl.

| | |
|---|---|
| ***E05D 7/04*** | (2006.01) |
| ***E05D 7/00*** | (2006.01) |
| ***E05D 3/02*** | (2006.01) |

(52) U.S. Cl.

CPC ..... *E05D 7/0054* (2013.01); *E05D 3/02* (2013.01); *E05Y 2900/148* (2013.01); *E05Y 2900/55* (2013.01)

(58) Field of Classification Search

CPC ... E05D 7/0045; E05D 7/0054; E05D 7/0415; E05D 7/0423; E05D 7/0027; E05D 2007/0063; E05D 2007/0072; E05D 3/02; E05Y 2900/148; Y10T 16/5324; Y10T 16/532; Y10T 16/53253; Y10T 16/53225

See application file for complete search history.

(56) References Cited

U.S. PATENT DOCUMENTS

| | | | | |
|---|---|---|---|---|
| 1,484,536 | A * | 2/1924 | Way | E05D 7/0054 16/242 |
| 1,540,581 | A * | 6/1925 | Way | E05D 7/0054 16/242 |
| 4,330,901 | A | 5/1982 | Sanders | |
| 4,489,974 | A * | 12/1984 | Warhol | B60J 3/0265 16/337 |
| 4,748,717 | A * | 6/1988 | Osborne | E05D 7/0027 16/240 |
| 5,307,539 | A | 5/1994 | Bauman | |
| 5,491,930 | A | 2/1996 | La See | |
| RE35,635 | E | 10/1997 | Bauman | |
| 5,711,052 | A | 1/1998 | Delaske | |
| 5,713,105 | A | 2/1998 | Toomey | |
| 5,794,310 | A | 8/1998 | Dallmann | |
| 5,964,011 | A | 10/1999 | Ruston et al. | |

(Continued)

*Primary Examiner* — Chuck Y Mah

(74) *Attorney, Agent, or Firm* — Nixon & Vanderhye P.C.

(57) ABSTRACT

An adjustable hinge assembly for connecting a moving part to a frame includes a first part secured to the frame and including an insert channel, and a second part secured to the moving part and including a shaft. An eccentric insert is positioned in the insert channel and is rotatable in the insert channel. The eccentric insert includes an offset channel at an end facing the second part, and the shaft of the second part is disposed in the offset channel. By rotating the eccentric part in the insert channel, a relative position of the moving part to the frame can be adjusted.

13 Claims, 2 Drawing Sheets

(56) References Cited

U.S. PATENT DOCUMENTS

| | | | | |
|---|---|---|---|---|
| 6,088,880 | A | 7/2000 | LaSee | |
| 6,112,371 | A | 9/2000 | Tremblay | |
| 6,134,751 | A | 10/2000 | Carrier et al. | |
| 6,158,086 | A | 12/2000 | De Souza | |
| 6,397,432 | B1 * | 6/2002 | di Vinadio | E05D 7/0045 16/235 |
| 6,434,791 | B1 * | 8/2002 | Chung | E05D 7/0423 16/251 |
| 6,484,363 | B1 * | 11/2002 | Chung | E05D 7/0054 16/235 |
| 6,643,896 | B2 | 11/2003 | Carrier | |
| 6,895,636 | B2 | 5/2005 | Nussbaum | |
| 6,926,363 | B2 | 8/2005 | Yamashita | |
| 7,162,774 | B1 * | 1/2007 | Von Resch | E05D 7/0054 16/236 |
| 7,246,412 | B2 | 7/2007 | Pacholke | |
| 7,500,286 | B2 * | 3/2009 | Soviknes | E05D 7/0027 16/243 |
| 7,506,407 | B2 * | 3/2009 | Ishiwata | E05D 11/082 16/340 |
| 7,603,746 | B1 * | 10/2009 | von Resch | E05D 7/0054 16/238 |
| 8,104,141 | B2 | 1/2012 | Yamashita | |
| 8,156,612 | B2 | 4/2012 | Yamashita | |
| 8,381,355 | B2 | 2/2013 | Pacini | |
| 8,925,150 | B2 | 1/2015 | Pacini | |

* cited by examiner

HINGE WITH ADJUSTABLE AXIS LOCATION AND LOCKING MECHANISM

CROSS-REFERENCES TO RELATED APPLICATIONS

This application claims the benefit of U.S. Provisional Patent Application No. 62/311,073, filed Mar. 21, 2016, the entire content of which is herein incorporated by reference.

STATEMENT REGARDING FEDERALLY SPONSORED RESEARCH OR DEVELOPMENT (NOT APPLICABLE)

BACKGROUND OF THE INVENTION

The invention relates to a hinge mount and, more particularly, to an adjustable hinge assembly for connecting a moving part to a frame.

Hinges are used in various constructions to secure a moving or pivotable part to a frame. Examples include doors, hatches and windows. When assembling the moving part in the frame, it is difficult to properly align the moving part with respect to the frame, and existing hinge assemblies are not easily adjustable.

BRIEF SUMMARY

It would be desirable to provide an adjustable hinge assembly that can facilitate positioning and alignment of the moving part, such as a window or the like, relative to a frame. The described embodiments utilize an eccentric insert with an offset channel to facilitate positioning of the moving part relative to the frame.

In an exemplary embodiment, an adjustable hinge assembly for connecting a moving part to a frame includes a first part secured to the frame and including an insert channel, and a second part secured to the moving part and including a shaft. An eccentric insert is positioned in the insert channel and is rotatable in the insert channel. The eccentric insert includes an offset channel at an end facing the second part, and the shaft of the second part is disposed in the offset channel.

The eccentric insert may include a drive channel at an opposite end. The drive channel may be shaped to receive a tool. The eccentric insert may be cylindrical and further may include a wedge lock disposed in a lock channel provided in an exterior surface of the eccentric insert. In this context, the wedge lock may be displaceable relative to the exterior surface to lock the eccentric insert in the insert channel. The eccentric insert further may include a set screw engageable with the wedge lock to control a position of the wedge lock relative to the exterior surface of the eccentric insert.

In some embodiments, the moving part may be a window, and the frame may be a window frame.

In another exemplary embodiment, an adjustable hinge assembly for connecting a moving part to a frame includes a first part secured to the frame and including an insert channel, and a second part secured to the moving part and including a shaft. An eccentric insert is positioned in the insert channel. The eccentric insert is cylindrical and is rotatable in the insert channel. The eccentric insert includes an offset channel at an end facing the second part. A center of the offset channel is spaced from a rotating axis of the eccentric part. The shaft of the second part is disposed in the offset channel, and rotation of the eccentric part serves to displace the second part relative to the first part.

In yet another exemplary embodiment, a method of adjusting the adjustable hinge may include the steps of (a) rotating the eccentric insert in the insert channel to displace the second part relative to the first part; (b) aligning the second part relative to the first part; and (c) locking a position of the eccentric insert in the insert channel when the second part is aligned with the first part. Step (a) may be practiced by inserting a tool into the drive channel and rotating the tool. Step (c) may be practiced by displacing the wedge lock relative to the exterior surface. Step (c) may be further practiced by engaging a set screw with the wedge lock to control a position of the wedge lock relative to the exterior surface of the eccentric insert.

BRIEF DESCRIPTION OF THE DRAWINGS

These and other aspects and advantages will be described in detail with reference to the accompanying drawings, in which.

DETAILED DESCRIPTION

Figure 1:
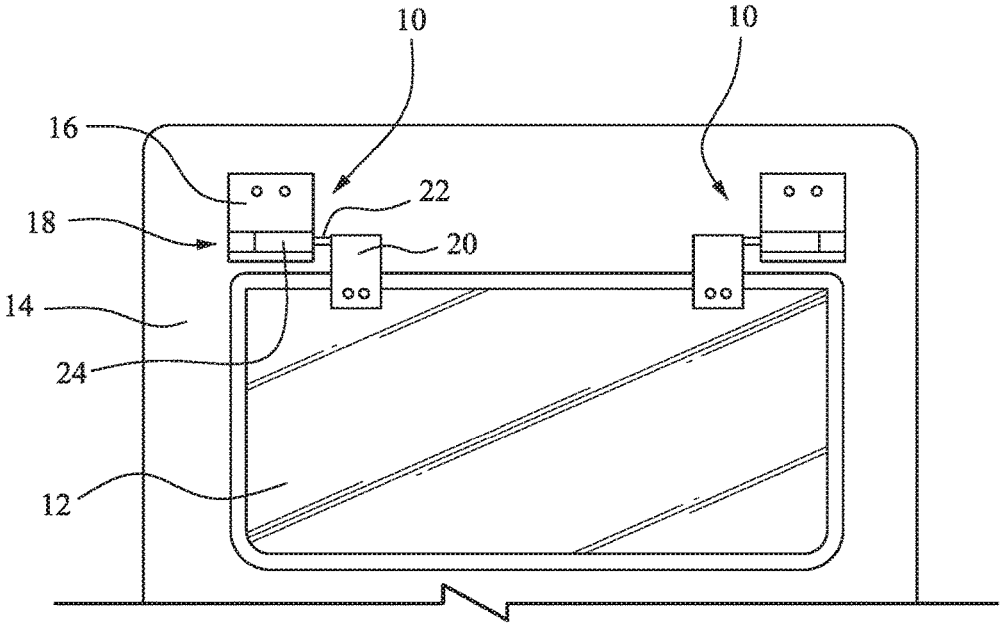
FIG. 1 shows an exemplary application of the adjustable hinge assembly for aligning a windshield with a window frame.

FIG. 1 shows an application of the adjustable hinge assembly according to the described embodiments to a window or windshield mounted in a window frame. The adjustable hinge assembly, however, is applicable to any structure in which a moving part is mounted to a frame, and the invention is not meant to be limited to the exemplary application shown in FIG. 1. FIG. 1 shows two hinge assemblies 10 for connecting a moving part 12 such as a window or windshield to a frame 14. Each adjustable hinge assembly 10 includes a female or first part 16 secured to the frame 14. The first part 16 includes an insert channel 18. A male or second part 20 is securable to the moving part 12 and includes a shaft 22.

Figure 2:
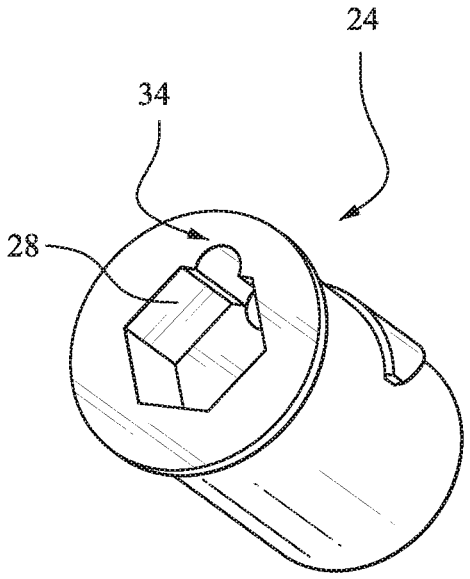
FIGS. 2 and 3 are perspective views of an eccentric insert.
Figure 3:
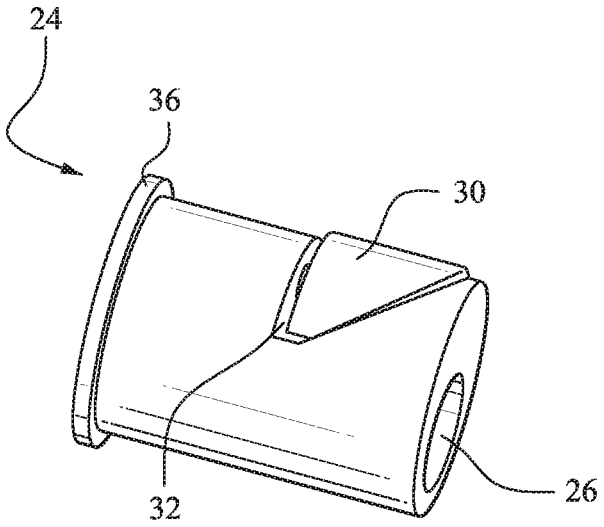

An eccentric insert 24, possibly in the form of a cylindrical canister or the like as shown in FIGS. 2 and 3, is positioned in the insert channel 18 of the second part 16 and is rotatable in the insert channel 18. The eccentric insert 24 includes an offset channel 26 at an end facing the second part 20. As noted above, the eccentric insert 24 is cylindrical so that the eccentric insert 24 can be rotated in the insert channel 18. A center of the offset channel 26 is spaced, i.e., offset, from a rotating axis of the cylindrical body of the eccentric insert 24. The shaft 22 of the second part 20 is disposed in the offset channel 26.

As shown in FIG. 2, the eccentric insert 24 may also include a drive channel 28 at an end opposite from the offset channel 26. The drive channel 28 is shaped to receive a tool such as an Allen wrench or a screwdriver or the like.

A wedge lock 30 is disposed in a lock channel 32 provided in an exterior surface of the eccentric insert 24. The wedge lock 30 is displaceable relative to the exterior surface to lock the eccentric insert 24 in the insert channel 18. As shown in FIG. 2, a set screw channel 34 may receive a set screw that is engageable with the wedge lock 30 to control a position of the wedge lock 30 relative to the exterior surface of the eccentric insert 24. For example, as the set screw is displaced in the set screw channel 34, the wedge lock 30 is shifted in the lock channel 32 (to the right in FIG. 3). By virtue of the complementary angled surfaces of the wedge lock 30 and the lock channel 32, displacement of the set screw causes the wedge lock 30 to be deflected outward and thereby lock the eccentric insert 24 in the insert channel 18.

As shown, the eccentric insert 24 may be provided with a shoulder portion 36 that is larger than the opening of the insert channel 18. The shoulder portion 36 can thus serve as a stop surface for inserting the eccentric insert 24 in the insert channel 18. Alternatively, the insert channel 18 may be provided with an interior lip or shoulder to define an insert location for the eccentric insert 24.

Figure 4:
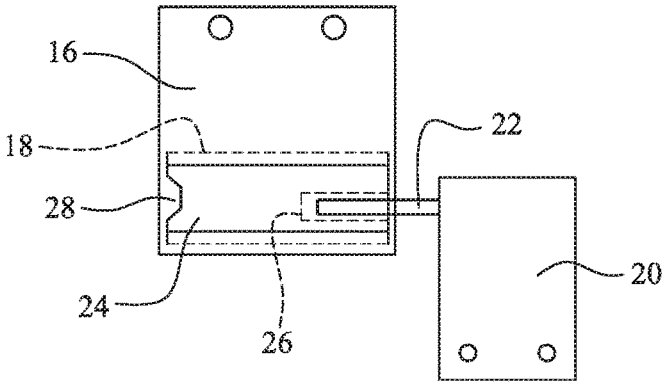
FIG. 4 is a functional illustration showing the process for adjusting the hinge assembly.

With reference to FIG. 4, in connecting the moving part 12 to the frame 14, the shaft 22 of the second part 20 is positioned within the offset channel 26 of the eccentric insert 24. The eccentric insert 24 is then rotated by a tool or the like in the insert channel 18, which thereby shifts a position of the second part 20 relative to the first part 16. The eccentric insert 24 is rotated until the moving part 12 is properly aligned in the frame 14. The assembly can also ensure proper seal compression around the perimeter of the moving part (particularly in the exemplary application to a windshield). A similar alignment procedure is conducted with any additional hinge assemblies. Once the moving part 12 is properly aligned in the frame 14, the set screw is tightened against the wedge lock 30, which forces the wedge lock 30 against the inside of the insert channel 18 of the first part 16, thereby locking the hinge assembly into proper alignment.

The adjustable hinge assembly of the described embodiments facilitates alignment and installation of a moving part such as a window or windshield relative to a frame such as a window frame. The assembly is inexpensive to manufacture and can be easily replaced if such replacement becomes necessary. Additionally, post-assembly adjustments can be readily made by simply releasing the wedge lock.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. An adjustable hinge assembly for connecting a moving part to a frame, the adjustable hinge assembly comprising:

a first part securable to the frame, the first part including an insert channel;

a second part securable to the moving part and including a shaft; and an eccentric insert positioned in the insert channel and rotatable in the insert channel, the eccentric insert including an offset channel at an end facing the second part, wherein the shaft of the second part is disposed in the offset channel, wherein the eccentric insert is cylindrical and further comprises a wedge lock disposed in a lock channel provided in an exterior surface of the eccentric insert, the wedge lock being displaceable relative to the exterior surface to lock the eccentric insert in the insert channel.

2. An adjustable hinge assembly according to claim 1, wherein the eccentric insert comprises a drive channel at an opposite end.

3. An adjustable hinge assembly according to claim 2, wherein the drive channel is shaped to receive a tool.

4. An adjustable hinge assembly according to claim 1, wherein the eccentric insert further comprises a set screw engageable with the wedge lock to control a position of the wedge lock relative to the exterior surface of the eccentric insert.

5. An adjustable hinge assembly according to claim 1, wherein the moving part comprises a window, and wherein the frame comprises a window frame.

6. An adjustable hinge assembly for connecting a moving part to a frame, the adjustable hinge assembly comprising:

a first part securable to the frame, the first part including an insert channel;

a second part securable to the moving part and including a shaft; and an eccentric insert positioned in the insert channel, wherein the eccentric insert is cylindrical and is rotatable in the insert channel, the eccentric insert including an offset channel at an end facing the second part, a center of the offset channel being spaced from a rotating axis of the eccentric part, wherein the shaft of the second part is disposed in the offset channel, wherein rotation of the eccentric part serves to displace the second part relative to the first part, and wherein the eccentric insert comprises a wedge lock disposed in a lock channel provided in an exterior surface of the eccentric insert, the wedge lock being displaceable relative to the exterior surface to lock the eccentric insert in the insert channel.

7. An adjustable hinge assembly according to claim 6, wherein the eccentric insert comprises a drive channel at an opposite end.

8. An adjustable hinge assembly according to claim 7, wherein the drive channel is shaped to receive a tool.

9. An adjustable hinge assembly according to claim 6, wherein the eccentric insert further comprises a set screw engageable with the wedge lock to control a position of the wedge lock relative to the exterior surface of the eccentric insert to thereby lock the eccentric insert in the insert channel of the first part.

10. An adjustable hinge assembly according to claim 6, wherein the eccentric insert includes a shoulder portion that is larger than an opening of the insert channel that serves as a stop surface to position the eccentric insert in the insert channel.

11. A method of adjusting an adjustable hinge that includes a first part secured to a frame and having an insert channel, a second part secured to a moving part and including a shaft, and an eccentric insert positioned in the insert channel and rotatable in the insert channel, wherein the eccentric insert includes an offset channel at an end facing the second part, and wherein the shaft of the second part is disposed in the offset channel, the method comprising:

(a) rotating the eccentric insert in the insert channel to displace the second part relative to the first part;

(b) aligning the second part relative to the first part; and (c) locking a position of the eccentric insert in the insert channel when the second part is aligned with the first part, wherein the eccentric insert comprises a wedge lock disposed in a lock channel provided in an exterior surface of the eccentric insert, and wherein step (c) is practiced by displacing the wedge lock relative to the exterior surface.

12. A method according to claim 11, wherein the eccentric insert comprises a drive channel at an opposite end, and wherein step (a) is practiced by inserting a tool into the drive channel and rotating the tool.

13. A method according to claim 11, wherein step (c) is further practiced by engaging a set screw with the wedge lock to control a position of the wedge lock relative to the exterior surface of the eccentric insert.

* * * * *